United States Patent [19]

McNeil

[11] Patent Number: 4,944,623

[45] Date of Patent: Jul. 31, 1990

[54] WINDOW CLEANING APPARATUS

[76] Inventor: Arley McNeil, Box 271, Sonoita, Ariz. 85637

[21] Appl. No.: 392,456

[22] Filed: Aug. 11, 1989

[51] Int. Cl.[5] ..... A47L 1/08

[52] U.S. Cl. ..... 401/25; 401/179; 401/207; 15/220 R

[58] Field of Search ..... 401/205, 206, 207, 219, 401/283, 176, 179, 181; 15/220 R, 143 R

[56] References Cited

U.S. PATENT DOCUMENTS

| | | | |
|---|---|---|---|
| 2,082,582 | 6/1937 | Kling | 401/207 |
| 2,249,401 | 7/1941 | Sieg | 401/176 |
| 2,521,967 | 9/1950 | Dean | 401/206 |
| 2,613,384 | 10/1952 | Collins . | |
| 2,997,732 | 8/1961 | Gilchrist | 401/207 |
| 3,175,242 | 3/1965 | Kamondy | 401/205 X |
| 3,455,638 | 7/1969 | Braswell | 401/207 X |
| 3,459,482 | 8/1969 | Fears . | |
| 3,783,469 | 1/1974 | Siemund . | |
| 3,837,747 | 9/1974 | Seymore | 401/205 |
| 4,312,093 | 1/1982 | Raab . | |

*Primary Examiner*—Richard J. Johnson
*Attorney, Agent, or Firm*—Leon Gilden

[57] ABSTRACT

A window cleaning apparatus is set forth wherein an elongate housing includes a downwardly extending forward housing receiving a sponge-like applicator mounted therein. Adjacent an apex of a second cylindrical housing directed downwardly from the first cylindrical housing is an upwardly extending boss including a resilient wiping strip secured therein. A ratcheting handle organization effects forward positioning of a piston to direct a cleaning fluid through the applicator sponge onto a window surface to be cleaned.

7 Claims, 1 Drawing Sheet

WINDOW CLEANING APPARATUS

BACKGROUND OF THE INVENTION

1. Field of the Invention

The field of invention relates to window cleaning apparatus, and more particularly pertains to a new and improved window cleaning apparatus wherein the same utilizes a self-contained, readily replenishable reservoir for the application of a cleansing solution to a windown surface.

2. Description of the Prior Art

The use of window cleaning apparatus is well known in the prior art. Heretofore, however, the apparatus has been of various organizations that have failed to accommodate an individual's need for a complete, easily used and conveniently configured organization to enable effective and complete cleansing of a window surface. For example, U.S. Pat. No. 3,459,482 to Feras provides for a cylindrical housing formed with a coaxially aligned applicator brush to direct an application of fluids forwardly of the brush-like surface from interiorly of the container without recourse to a pressurizing unit interiorly of the container.

U.S. Pat. No. 2,521,967 to Dean sets forth a window cleaning device wherein a forwardly oriented cleaning tip, including an interior chamber for containment of a cleansing solution with a teaching of utilizing particular pressurizing means, as opposed to the instant invention to enable selective directing of a fluid through the cleaning head and for alternatively drawing a cleaning solution through the cleaning head into the chamber, as desired.

U.S. Pat. No. 2,613,384 to Collins provides a window washing device utilizing an elongate handle and a forwardly oriented cleansing tip with means to reorient the positioning of the cleaning tip relative to the handle.

U.S. Pat. No. 3,783,469 to Siemund provides for a window cleaning organization with a forward head with sponges mounted at one end of the head and a rubber scraper blade at the other end for selective washing and cleansing of a window surface.

U.S. Pat. No. 4,312,093 to Raab provides for a window cleaning device with handle utilizing a ball and socket arrangement to orient a forward cleaning head relative to the handle.

As such, it may be appreciated that there is a continuing need for a new and improved window cleaning apparatus wherein the same addresses both the problems of ease of use and effectiveness in organization, and in this respect, the present invention substantially fulfills this need.

SUMMARY OF THE INVENTION

In view of the foregoing disadvantages inherent in the known types of windown cleaning apparatus now present in the prior art, the present invention provides a window cleaning apparatus wherein the same utilizes a pressurizable interior chamber for directing a cleansing solution exteriorly of an applicator head. As such, the general purpose of the present invention, which will be described subsequently in greater detail, is to provide a new and improved window cleaning apparatus which has all the advantages of the prior window cleaning apparatus and none of the disadvantages.

To attain this, a window cleaning apparatus includes a first elongate cylindrical housing at an axial obtuse angle to a second cylindrical housing with a second cylindrical housing including an inner chamber in communication with an inner chamber of the first cylindrical housing. A threadedly mounted cap includes an applicator sponge secured to a forward end of the second cylindrical housing with a fluid chamber arranged between the applicator sponge and a reciprocatable piston mounted within the first cylindrical housing. The applicator piston includes an elongate rod with ratchet notches cooperative with a ratchet mechanism selectively releasable to enable suctioning of a cleansing solution through the applicator sponge interiorly of the first and second cylindrical housings. A rubber wiper blade is mounted within a groove of a boss member formed at an upper surface of the cylindrical housing at an opposite side to that of the ratcheting handle mechanism of the device with the applicator sponge directed at an angle downwardly from the from the wiping blade to enable access of the wiping blade to a freshly washed surface.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the forgoing abstract is to enable the U.S. Patent and Trademark Office and the public generally, and especially the scientists, engineers and pracitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved window cleaning apparatus which has all the advantages of the prior art window washing apparatus and none of the disadvantages.

It is another object of the present invention to provide a new and improved window cleaning apparatus which may be easily and efficiently manufactured and marketed.

It is a further object of the present invention to provide a new and improved window cleaning apparatus which is of a durable and reliable construction.

An even further object of the present invention is to provide a new and improved window cleaning apparatus which is susceptible of a low cost of manufacture with regard to both materials and labor, and which accordingly is then susceptible of low prices of sale to the consuming public, thereby making such window cleaning apparatus economically available to the buying public.

Still yet another object of the present invention is to provide a new and improved window cleaning apparatus which provides in the apparatuses and methods of the prior art some of the advantages thereof, while simultaneously overcoming some of thge disadvantages normally associated therewith.

Still another object of the present invention is to provide a new and improved window cleaning apparatus wherein the same allows for pressurizing a fluid through an applicator sponge onto a window surface and alternatively enabling suctioning of cleansing solution through the applicator sponge interiorly of a housing associated with the apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
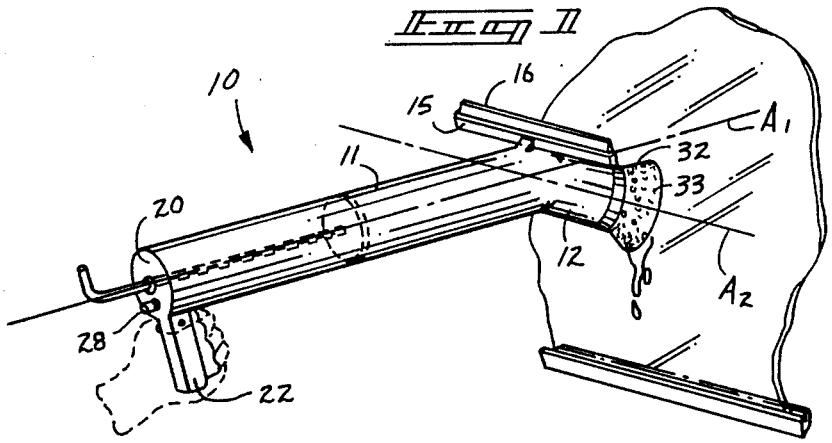
FIG. 1 is an isometric illustration of the instant invention.
Figure 2:
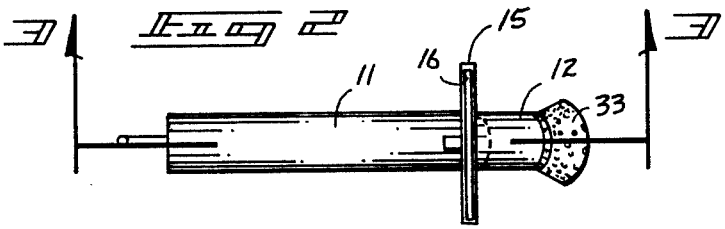
FIG. 2 is a top orthographic view of the instant invention.

With reference now to the drawings, and in particular to FIGS. 1 to 4 thereof, a new and improved window cleaning apparatus embodying the principlies and concepts of the present invention and generally designated by the reference numeral 10 will be described.

Figure 3:
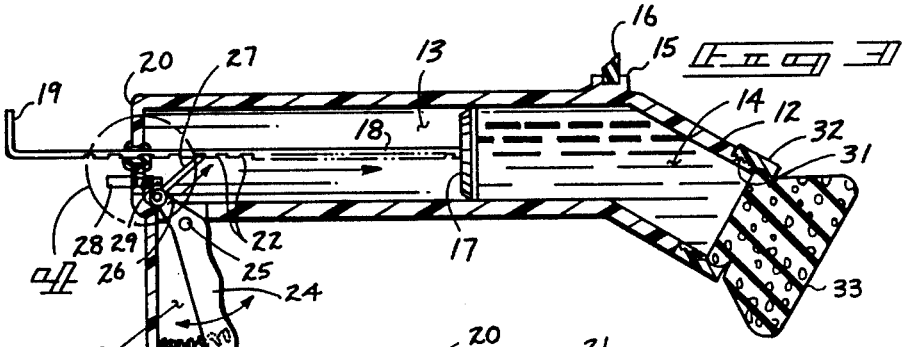
FIG. 3 is an othographic view, taken along the lines 3—3 of FIG. 2, in the direction indicated by the arrows.

More specifically, the window cleaning apparatus 10 essentially comprises a first, elongate cylindrical housing 11 defined by an elongate axis arranged at an obtuse angle to an axis of a second cylindrical housing 12 to direct the second cylindrical housing at a downward orientation relative to the first cylindrical housing. The first cylindrical housing includes a first elongate chamber 13 in communication with a second chamber 14 defined by the interior volume of the second cylindrical housing. Positioned adjacent an apex of the boundary defining the junction of the first and second cylindrical housing is an upstanding boss member 15 containing an enclosed groove. An elastomeric wiping strip 16 is fixedly positioned within the groove. The downward orientation of the second cylindrical housing anables axis of the wiping strip 16 to remove excess fluid from a window surface. The boss member 15 is tangentially positioned orthogonally to an axis defined by the first cylindrical housing on the exterior surface of the first cylindrical housing adjacent the second cylindrical housing, as illustrated in FIG. 3 for example.

A piston 17 is reciprocatably mounted in a sealing engaement with the interior surface of the first chamber 13 and includes a piston rod 18 orthogonally and fixedly secured to a rear surface of the piston 17, wherein the piston rod 18 extends through a rear wall 20 of the first cylindrical housing 11, through a bushing **20*a*, and terminates in a rod handle 19 arranged at an orthogonal angle relative to the piston rod 18. The piston rod 18 further includes a series of ratchet notches 21 extending upwardly in a direction reversed to that of the orientation of the handle 13 and formed into the surface of the piston rod 18**.

Figure 4:
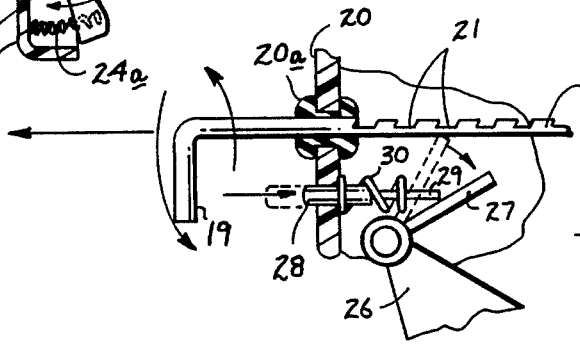
FIG. 4 is an orthographic view, somewhat enlarged, of section 4 as set forth in FIG. 3.

Extending at an orthogonal angle downwardly relative to the exterior surface of the first cylindrical housing 11 at the reverse side to that of the boss member is a housing handle 22 containing a handle chamber 23 for pivotally receiving an actuator lever 24. The lever 24 includes a lever pivot 25 arranged adjacent an upper end of the handle chamber 23 and enables pivoting of a remote end 26 at an opposite side of the lever pivot 25 to that of a lever spring **24*a* positioned within the handle chamber 23 at a rear surface of the actuator lever 24 at a lowermost portion of the handle 22. The remote end 26 extends interiorly of the first chamber 13 and includes an engagement flange 27 resiliently biased at a raised orientation relation to the remote end 26 for engagement and actuation with the ratchet notches 21. A release rod 28 is mounted underlying the piston rod 18 and includes a forward tip 29 extending interiorly of the first chamber 13 for selective engagement with the engagement flange 27. A captured spring 30 maintains the release rod 28 in a retracted position. Upon depressing of the release rod 28, the engagement flange 27 is biased in disengagement with the ratchet notches 21 to enable rotation of the rod handle 19 positioning a smooth surface of the piston rod 18 in communication with the engagement flange 27 to enable retraction of the piston rod 18 and associated piston 17 and thereby effect a vacuum created within the first and second chambers 13 and 14 respectively defined between a forward face of the piston 17 and the rear face of an applicator sponge 33 secured to a forward end of the second housing 12. In this manner, cleansing solution is drawn into the aforenoted chamber by a suction action upon withdrawal of the handle and piston rod 18 rearwardly of the first cylindrical housing 11, as illustrated in FIG. 4 for example. The applicator sponge 33 is fixedly mounted within an interanlly threaded cap 32 that is selectively secured to a threaded forward end 31 of the second cylindrical housing 12**.

In use, an individual merely depresses the actuator lever 24 to maintain a pressurizing of a fluid contained within the chamber defined between the piston 17 and the appicator sponge 33 and maintain a constant flow of cleansing solution onto a window surface, as illustrated in FIG. 1. For replenishment of the fluid, the handle 19 is merely rotated one hundred eighty degrees and upon withdrawing of the handle and associated piston rod and piston, cleansing solution is drawn interiorly of the apparatus for replenishment and continued use of the apparatus for cleansing of windows.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is as being new and desired to be protected by Letters Patent of the U.S. is as follows:

1. A window cleaning apparatus comprising, an elongate body including a first hollow cylindrical housing secured in alignment to a second hollow cylindrical housing, wherein the first cylindrical housing defines a first chamber in communication with a second chamber defined within the second cylindrical housing, and a porous applicator head mounted at a forward end of the second cylindrical housing remote from the first cylindrical housing, and pressurizing means contained within the first cylindrical housing to direct a quantity of cleansing fluid contained within the elongate body between the pressurizing means and the applicator head for directing the fluid through the applicator head onto a surface to be cleaned, and wherein the first cylindrical housing is defined by a first axis and the second cylindrical housing is defined by a second axis, wherein the second axis is arranged at an obtuse angle relative to the first axis, and wherein the porous applicator head includes a truncated conical sponge member integrally secured within an internally threaded cap, the internally threaded cap being selectively securable to the second cylindrical housing.

2. A window cleaning apparatus as set forth in claim 1 including an elongate boss tangentially secured to an exterior surface of the first cylindrical housing adjacent a junction of the first cylindrical housing and the second cylindrical housing and the boss including an elongate, elastomeric wiper stip spaced above the sponge member.

3. A window cleaning apparatus as set forth in claim 2 wherein the pressurizing means includes a piston orthogonally mounted to a coaxially positioned piston rod, the piston and piston rod reciprocatably mounted within the first cylindrical housing, and the piston rod including a rear end directed exteriorly through a rear end surface of the first cylindrical housing and terminating in a handle, the handle arranged orthogonally relative to the piston rod.

4. A window cleaning apparatus as set forth in claim 3 including a first cylindrical housing handle directed and arranged orthogonally relative to the first cylindrical housing on an exterior surface thereof diametrically opposed to the boss member, the housing handle including a cavity, and an actuator lever pivotally mounted within the cavity with a lever spring mounted interiorly of the cavity and a rear surface of the handle to maintain the handle in an extended position relative to the cavity, and a remote end of the lever spaced beyond a pivot, the remote end including an engagement flange, the engagement flange biased at a raised orientation relative to the remote end.

5. A window cleaning apparatus as set forth in claim 4 wherein the piston rod includes a series of notches directed interiorly of an exterior surface of the piston rod and arranged in orientation opposed to that of the piston rod handle, wherein the notches are arranged for engagement with the engagement flange in a first position and are diametrically opposed to the engagement flange in a rotated second position.

6. A window cleaning apparatus as set forth in claim 5 further including a release rod arranged in alignment with the engagement flange spaced underlying the piston rod and directed through the rear wall of the first cylindrical housing, the release rod including a forward tip in selective engagement with the engagement flange with a release rod spring captured between the forward tip and an interior surface of the rear wall of the first cylindrical housing.

7. A window cleaning apparatus as set forth in claim 6 wherein the piston is in complementary sealing engagement with the first chamber of the first cylindrical housing.

* * * * *